US008857517B2

(12) United States Patent
Trahan et al.

(10) Patent No.: US 8,857,517 B2
(45) Date of Patent: Oct. 14, 2014

(54) WELLBORE CLEANOUT TOOL

(75) Inventors: Kevin O. Trahan, The Woodlands, TX (US); Benton T. Knobloch, Jr., Broussard, LA (US); Todd J. Roy, Youngsville, LA (US); Javier E. Bolivar, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 246 days.

(21) Appl. No.: 13/387,378

(22) PCT Filed: Jul. 27, 2010

(86) PCT No.: PCT/US2010/043397

§ 371 (c)(1),
(2), (4) Date: Jan. 27, 2012

(87) PCT Pub. No.: WO2011/017105

PCT Pub. Date: Feb. 10, 2011

(65) Prior Publication Data

US 2012/0118577 A1 May 17, 2012

Related U.S. Application Data

(60) Provisional application No. 61/229,072, filed on Jul. 28, 2009.

(51) Int. Cl.

| | |
|---|---|
| ***E21B 37/00*** | (2006.01) |
| ***E21B 37/02*** | (2006.01) |
| ***E21B 21/10*** | (2006.01) |
| ***E21B 27/00*** | (2006.01) |

(52) U.S. Cl.

CPC ..... *E21B 37/02* (2013.01); *E21B 21/103* (2013.01); *E21B 27/005* (2013.01)

USPC ..... 166/312; 166/318; 166/177.3

(58) Field of Classification Search

USPC ..... 166/177.3, 173, 202, 318, 311, 185, 166/312

See application file for complete search history.

(56) References Cited

U.S. PATENT DOCUMENTS 6,186,227 B1 * 2/2001 Vaynshteyn et al. ..... 166/120
6,250,387 B1 6/2001 Carmichael et al.

(Continued)

FOREIGN PATENT DOCUMENTS

GB 2272923 A 6/1994
GB 2323111 A 9/1998

(Continued)

OTHER PUBLICATIONS

PCT International Search Report, PCT/US2010/043397, issued May 23, 2011.

(Continued)

*Primary Examiner* — David Andrews
*Assistant Examiner* — Steven MacDonald
(74) *Attorney, Agent, or Firm* — Scott Richardson; Booth Albanesi Schroeder LLC

(57) ABSTRACT

A well tool (100) for use in cleaning a well of fluids and debris characterized by one or more wiper elements (30) for swabbing the wellbore and internal passageways (11, 15) and valves (70, 72) in the tool, permitting forward and reverse fluid circulation through the tool to bypass the wiper elements.

14 Claims, 6 Drawing Sheets

(56) References Cited

U.S. PATENT DOCUMENTS

| | | | | |
|---|---|---|---|---|
| 6,253,861 | B1 | 7/2001 | Carmichael et al. | |
| 6,347,667 | B1 | 2/2002 | Howlett et al. | |
| 6,497,295 | B1 | 12/2002 | Carmichael et al. | |
| 6,651,744 | B1 * | 11/2003 | Crawford | 166/311 |
| 6,883,605 | B2 | 4/2005 | Arceneaux et al. | |
| 7,383,881 | B2 | 6/2008 | Telfer | |
| 2003/0034177 | A1 | 2/2003 | Chitwood | |
| 2004/0112588 | A1 | 6/2004 | Mullins | |
| 2006/0169463 | A1 * | 8/2006 | Howlett | 166/386 |
| 2006/0219410 | A1 * | 10/2006 | Booth | 166/311 |
| 2009/0126933 | A1 | 5/2009 | Telfer | |

FOREIGN PATENT DOCUMENTS

| | | | |
|---|---|---|---|
| GB | 2335687 | A | 9/1999 |
| GB | 2341405 | B | 9/2002 |
| GB | 2342666 | B | 1/2003 |
| WO | 9743517 | A1 | 11/1997 |
| WO | 9823841 | A | 6/1998 |
| WO | 02061236 | A1 | 8/2002 |
| WO | 2004055317 | A2 | 7/2004 |
| WO | 2005052305 | A1 | 6/2005 |
| WO | 2006016137 | A1 | 2/2006 |
| WO | 2006123109 | A1 | 11/2006 |
| WO | WO2007/003894 | * | 1/2007 |
| WO | 2007140612 | A1 | 12/2007 |

OTHER PUBLICATIONS

MI SWACO, 2008 Catalog Specialized Tools, 2008, pp. 1-59, M-I L.L.C., Houston, Texas.

M-I, LLC v. Chad Lee Stelly, et al., In the United States District Court for the Southern District of Texas, Houston Division, C.A. No. 4:09-CV-01552, Third Amended Complaint (Exhibits A-G were designated Attorney Eyes Only at time of filing and have been removed), Sep. 7, 2010.

M-I, LLC v. Chad Lee Stelly, et al., In the United States District Court for the Southern District of Texas, Houston Division, C.A. No. 4:09-CV-01552, Answer and Counterclaims to Plaintiff's Third Amended Complaint, Jan. 28, 2011.

M-I, LLC v. Chad Lee Stelly, et al., In the United States District Court for the Southern District of Texas, Houston Division, C.A. No. 4:09-CV-01552, Order of Dismissal with Prejudice, Jun. 28, 2012.

Written Opinion and Search Report, dated Oct. 18, 2013, Singapore Patent Application No. 201200521-1, filing date Jul. 27, 2010, 14 pages.

Patent Examination Report, dated Nov. 26, 2013, Australian Patent Application No. 2010281419, 4 pages.

* cited by examiner

WELLBORE CLEANOUT TOOL

This application is a national stage filing under U.S.C. sctn.371 of PCT Application No. PCT/US10/43397 filed on Jul. 27, 2010. PCT/US10/43397 was published in English as Publication No. WO 2011/017105 on Feb. 10, 2011. PCT/US10/43397 claims priority to U.S. provisional application 61/229,072 filed on Jul. 28, 2009.

BACKGROUND

1. Technical Field

This invention relates, generally, to downhole well tools and methods used in drilling and servicing of hydrocarbon wells, such as oil and gas wells. More specifically, this invention relates to tools used to clean wellbores and to clean the fluids contained in the wellbores.

2. Background Art

The invention provides a well cleanout tool, specifically, this invention relates to tools having external cleaning elements, such as a wiper, assembled in a tubing string. These tools are used to clean wellbores and to clean the fluids contained in the wellbores by circulating fluids through and around the tubing string. One, cleaning method includes running the tool into the well while cleaning the wellbore and forcing down the annulus and up through the tubing string. Another method includes cleaning through forward and reverse circulation. The tool of the present invention accommodates and can be used to perform all three methods.

As used herein, the words "comprise," "have," "include," and all grammatical variations thereof are each intended to have an open, non-limiting meaning that does not exclude additional elements or steps. The term "wellbore" refers to the subterranean well opening, including cased and uncased. The term "tubing string" is used generically to refer to tubular members positioned in a wellbore, such as drill pipe, tubing and the like. The terms "forward circulation" and "reverse circulation" are used to describe well known well processes. "Forward circulation" refers to processes wherein well fluids are pumped into the wellbore through the interior of the tubing string and flow out of the well around the outside of the tubing string (annulus). In "reverse circulation", well fluids are pumped into the well along the outside of the string and are discharged from the well through the interior of the string. The term "well fluids" refers broadly to any fluids found in a wellbore. The term "wiper" is used broadly herein to refer to a swab cup-like structure that extends to the wellbore wall. The wiper forms a sliding seal with the interior wall of the wellbore and, when lowered into the well, seals against the wellbore wall and removes well fluids and solids that adhere to the inside of the wellbore. Typically, wipers have one or more cup-type elements that prevent flow. Examples of wipers are illustrated in U.S. Pat. Nos. 6,347,667 and 6,883,605 and U.S. Publication #2009/0126933. "Casing centralizer" refers to the device secured around a tubing string or tool, typically at regular intervals, to center it in the wellbore. A "gauge ring" is a ring assembled in a tubing string or tool used to measure, guide and centralize it in the wellbore.

SUMMARY OF THE INVENTION

The present invention provides a tool for assembly in a tubing string for use in cleaning the wellbore and well fluids. The tool preferably contains wiper elements for removing debris from the wellbore wall and or sealing the annulus around the tool. Valves and passageways are provided in the tool to accommodate both forward and reverse circulation to flush the debris from the wellbore.

BRIEF DESCRIPTION OF THE DRAWING

The drawing is incorporated into and forms a part of the specification to illustrate at least one embodiment and example of the present invention. Together with the written description, the drawing serves to explain the principals of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing in which.

DETAILED DESCRIPTION OF THE INVENTION

Figure 1:
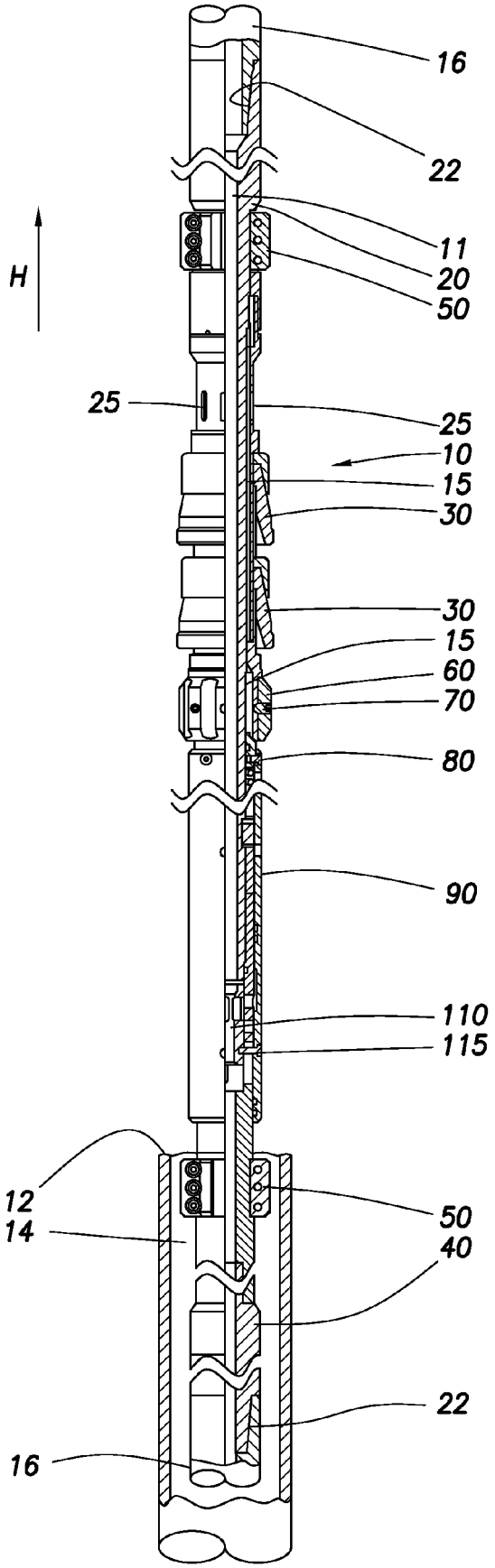
FIG. 1 is a partial section view of the wellbore cleanout tool of the present invention.

Referring now to the drawings, wherein like reference characters refer to like or corresponding parts throughout the several figures, there is illustrated in FIG. 1, wellbore cleanout tool 10 is positioned in a wellbore 12 forming an annulus 14 around the tool inside the wellbore. Typically, the wellbore 12 contains well fluids, such as drilling mud, debris such as cuttings and the like and can be cased (as illustrated) or uncased. In FIG. 1, the arrow "H" references the uphole or well head direction, without regard to the actual physical orientation of the wellbore. The wellbore cleanout tool 10 has an elongated tubular shaped body comprising a main mandrel 20 with means thereon, typically threads 22, for connecting the tool in a tubing string 16. In the illustrated embodiment the tool 10 is connected in a tubing string. In this embodiment the tubing string 16 is a drill string and the tool 10 is connected in the tubing string above the drill bit (not shown). A central passageway 11 extends the length of the tool 10, as shown, and when assembled in a tubing string the passageway is in fluid communication with the interior of the string.

The wellbore cleanout tool 10 includes one or more sealing elements, such as, wiper elements 30. In this embodiment, two wiper elements 30 are supported from the mandrel 20. As illustrated, the wiper elements 30 are directed down-hole away from the well head and function to engage the interior of the wellbore 12 and block or restrict flow of fluids in the annulus 14, past the wellbore cleanout tool 10. Preferably, wiper elements 30 are made at least in part from a resilient material which effectively prevents fluids from flowing along the annulus 14 between the outer diameter of the wellbore cleanout tool 10 and the inner diameter of the wellbore 12. As the tubing string 16 including wellbore cleanout tool 10 is moved (nm) down-hole into the well (in the reverse direction of arrow H), the wiper elements 30 prevent wellbore fluids from bypassing the tool along the annulus in the up-hole direction of arrow H. As the wiper elements 30 move into the well (slide along the wall of the wellbore) the wellbore fluids are forced ahead of the tool 10 while wellbore fluids are added to the annulus at the well head.

The lower end (down-hole end) of the wellbore cleanout tool 10 comprises a bottom sub 40 with a means, threads 22, for connecting to a tubing string 16. Centralizers 50 may be provided on the exterior of the tool to position the tool in the wellbore 12, and a gauge ring 60 may be provided to ensure or verify the wellbore's clearances/dimensions. For example, the centralizers 50 and gauge ring 60 cooperate to centrally position the wiper elements 30 in the wellbore 12.

The structural details, advantages and features of wellbore cleanout tool 10 of the present invention, may be best described in conjunction with a description of the three primary operating modes/positions of the tool, i.e., first position, tripping in the hole; second position, reverse circulation; and third position, forward circulation.

Figure 2:
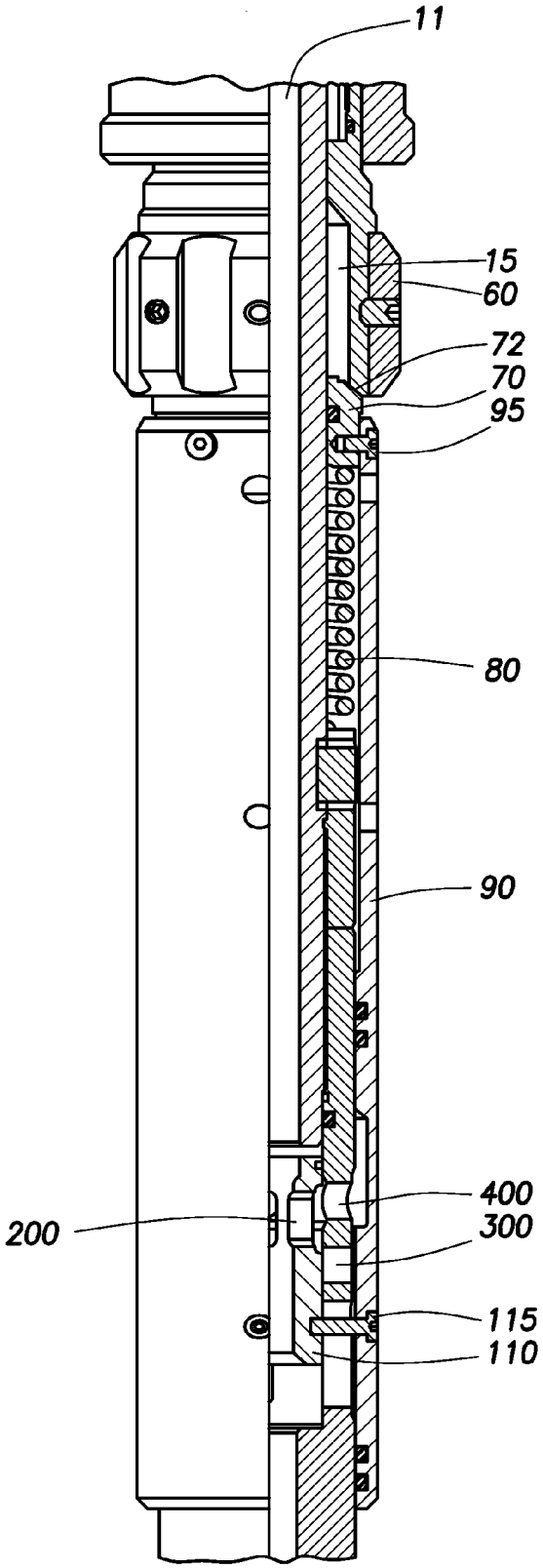
FIG. 2 is a more detailed section view of a portion of the cleanout tool of the present invention, in the first position.

Tripping in the hole (first position) is illustrated in FIGS. 1 and 2. In this first position, the wellbore cleanout tool 10 acts substantially as a "solid tool," i.e., one comprising simply a mandrel with down-hole directed swab cups on the exterior. Wellbore cleanout tool 10 has an open central bore 11 connected to the interior of the tubing string. It being understood that there may be additional tubular members and tools connected below wellbore cleanout tool 10, such as, a drill bit. As wellbore cleanout tool 10 is lowered into wellbore 12, sealing wiper elements 30 (create a seal between the tool and the interior wall of the wellbore 12) force the well fluids along the only available flow path, which is down-hole along annulus 14. Ultimately, the well fluids flow into the lowermost end of the tubing string and back up the bore of the tubing string, through the central bore 11 of the wellbore cleanout tool 10 and ultimately to the surface. Tripping occurs during drilling operations when it is necessary to replace the drill bit by removing the drill string and thereafter reinserting the string in the wellbore. Typically, the wellbore walls and wellbore fluids will contain heavy debris, such as, rock cuttings and caked mud. As the tool is lowered into the well the wellbore wall contacted to dislodge debris and the debris laden wellbore fluid is circulate up the drill string.

Figures 3, 3A:
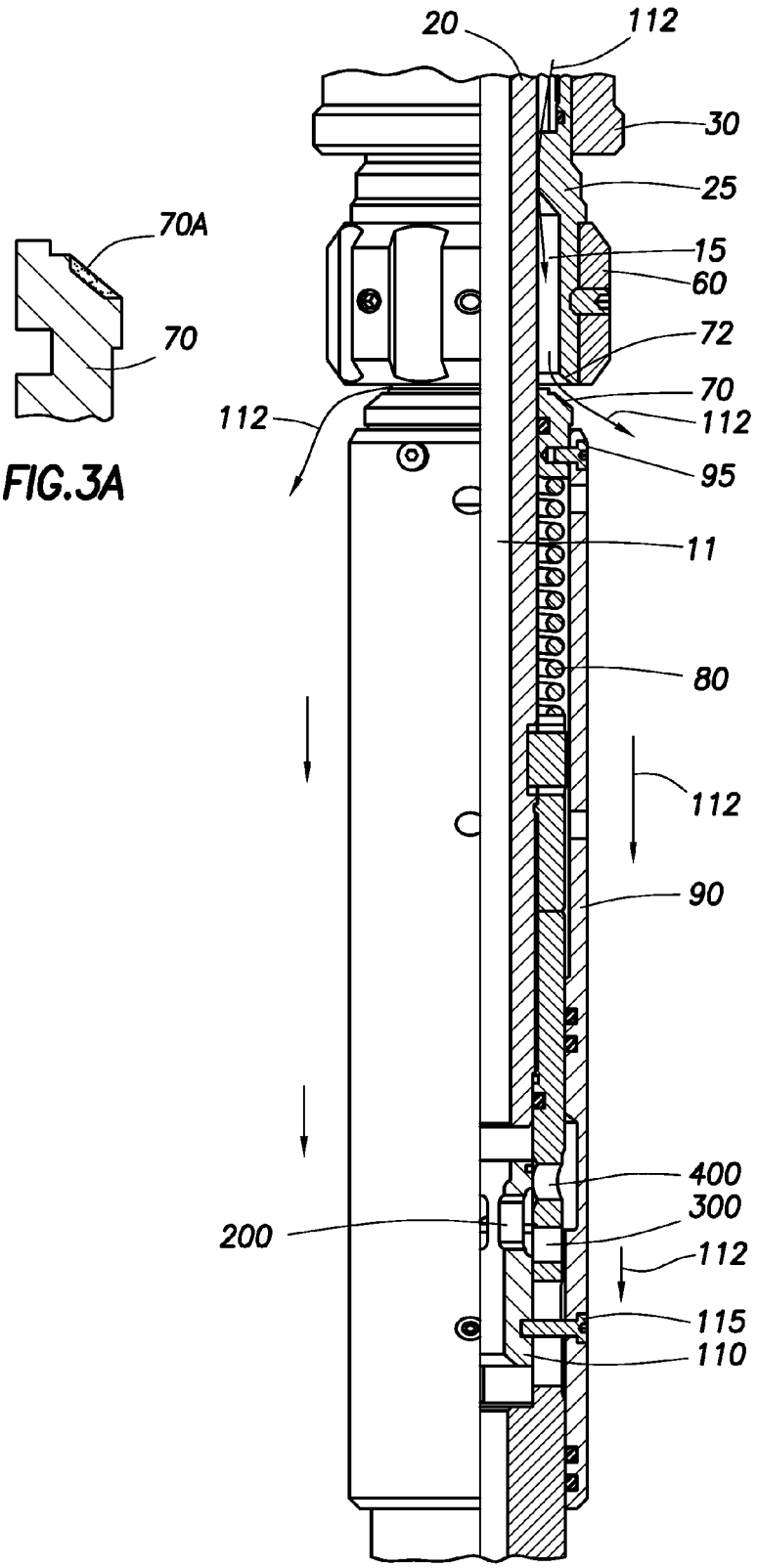
FIG. 3 is a more detailed section view of a portion of the cleanout tool of the present invention, in the second position.
FIG. 3A is a detailed view of check valve plunger of the present invention, showing resilient sealing face thereon.

Reverse circulation (second position) is illustrated in FIG. 3. FIG. 3 illustrates the wellbore cleanout tool typically maintained in this position. Generally, in reverse circulating, fluid is pumped down the annulus 14, and back up the central bore 11 of the wellbore cleanout tool 10 and up through the tubing string to the surface. With wellbore cleanout tool 10 positioned at a desired downhole location within a wellbore 12, fluid is pumped into the annulus 14 at the surface. Wiper elements 30 block or restrict passage of the fluid by wellbore cleanout tool 10. During reverse circulation, the wellbore cleanout tool 10 allows fluids enter a second passageway to bypass the wiper elements 30, as shown by flow arrows 112.

As is illustrated in FIG. 3, well fluid flows into and through a second set of passageways 15 in wellbore cleanout tool 10. These passageways are formed by slots in the slotted mandrel 25. The bypassing flow is identified by flow arrows 112. The slotted mandrel 25 has longitudinally extending slots in its internal wall and is mounted around the mandrel 20. The slots form flow passageways 15 along the exterior of mandrel 20. These passages extend under (from above to below) the wiper elements 30 to bypass the wiper elements.

As is illustrated in FIGS. 3 and 3A, a check valve is positioned at the lower end of the passageways 15 to permit well fluids to flow downhole past the wiper elements but prevent fluids from flowing up-hole through passageways 15. The check valve comprises an annular plunger 70 resiliently urged by spring 80 into contact with a plunger seat 72 to close off the lower end of passageways 15. The valve element or plunger 70 is connected to an outer sleeve 90 by screws 95. The sleeve 95 and plunger 70 are mounted to longitudinally slide along the exterior of the tool. Plunger 70 has a sealing face 70*a* that slides in and out of contact with the plunger seat 72.

When fluid is pumped down the annulus 14, fluid will enter passageways 15 and fluid pressure will impose a downward force on check valve plunger 70. Check valve plunger 70 is normally resiliently urged upwardly by spring 80 or other biasing means. When the pressure is raised to a sufficient value, the resulting force on check valve plunger 70 will move the check valve plunger 70 off of plunger seat 72. Once check valve plunger 70 is unseated, fluid will flow back into the annulus 14, down the annulus 14 to the lowermost end of the downhole assembly, and back up the bore of the downhole assembly (including wellbore cleanout tool 10) to the surface. In this manner debris laden wellbore fluid is flushed out of the tubing string before drilling begins.

Figure 4:
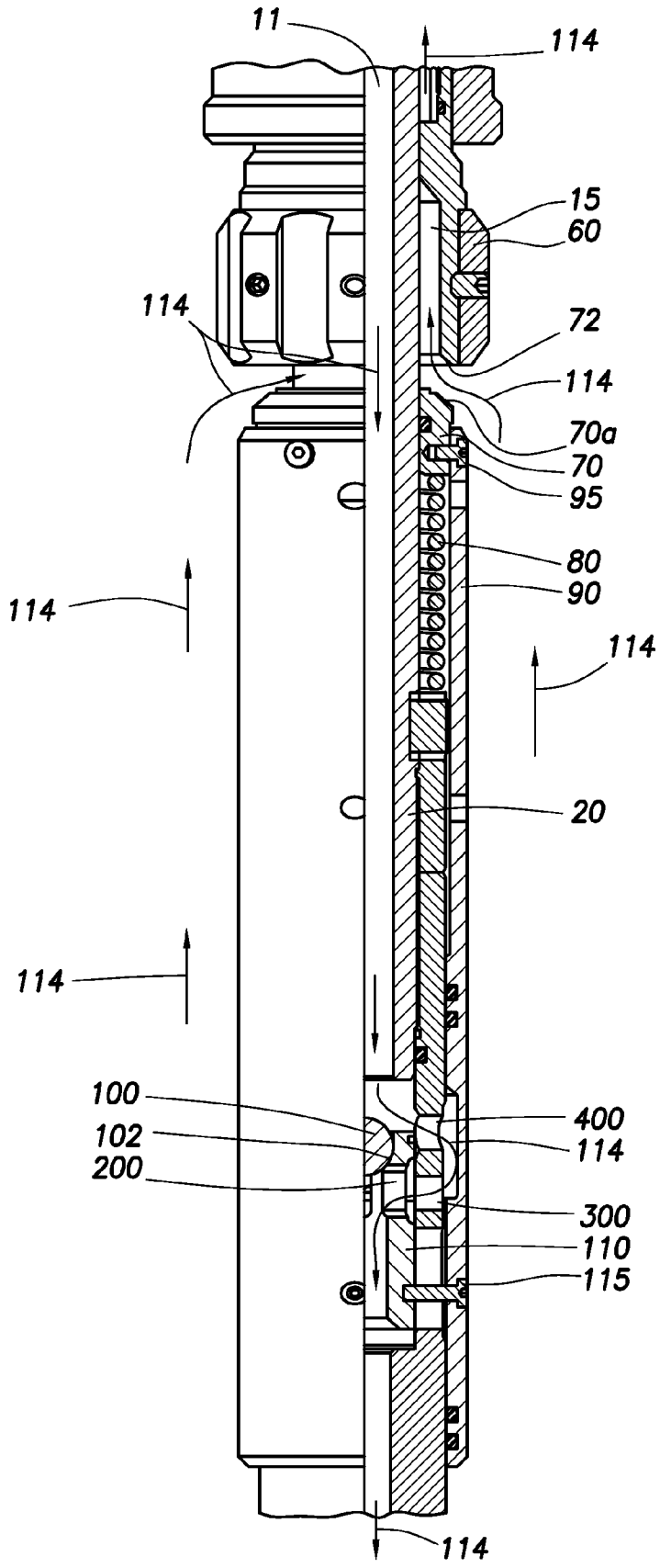
FIG. 4 is a more detailed section view of a portion of the cleanout tool of the present invention, in the third position.

Forward circulation (third position) is illustrated in FIG. 4. Generally, in forward circulation, fluid is pumped down the bore of the tubing string, through the bore of the downhole assembly (including wellbore cleanout tool 10) to circulate back up the tubing string/casing annulus 14 to the surface as shown by flow arrows 114. For example, during drilling fluids are pumped down the tubing string to the drill bit. A ball is dropped or pumped down the tubing string to change the wellbore cleanout tool 10 from the reverse circulation position illustrated in FIG. 3 to the forward circulation position illustrated in FIG. 4.

As illustrated in FIG. 4, ball 100 is dropped or pumped down the tubing string until it contacts and rests on an annular seat 102 on inner sleeve 110. Inner sleeve 110 is connected by screws 115 to the outer sleeve 90 to move with the outer sleeve 90. As pressure on the fluid in the central bore 11 is increased, a downward force is applied to the ball 100 and plunger 110. As illustrated in FIG. 4, a sufficient pressure and resulting force will compress spring 80 and move the ball 100, seat 102 and plunger 110 downward. This downward movement aligns ports 200 and 300 and opens ports 400, and thereby creating a third set of passageways. This third set of passageways bypass (as indicated by arrows 114) the ball 100.

The downward movement of the valve plunger 70, also moves sealing face 70*a* axially away from plunger seat 72 allowing fluid back to the well head to bypass the wiper elements 30 by way of passageways 15 and flow to the surface along annulus 14.

Figure 5:
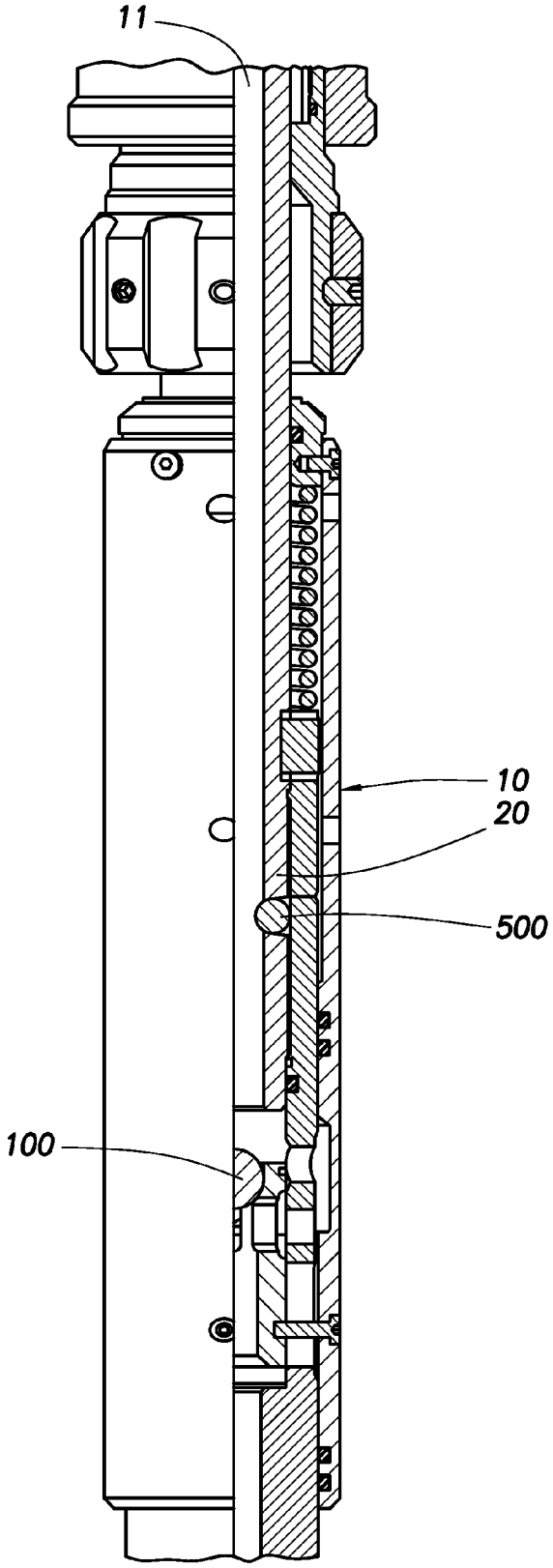
FIG. 5 is a view similar to FIG. 4 illustrating one embodiment of the ball retainer.

In an alternative embodiment, the ball 100 is assembled and retained in the tool before the tool is lowered into the well. In FIG. 5, the ball 100 is retained in the bore by a ball 500 protruding into the central bore 11. The ball 500 mounted in a socket in the wall of mandrel 20. When circulation is reversed the ball 100 is prevented from flowing up the central bore 11 by interfering contact with the ball 500. It is envisioned that in place of the ball 500, pins, screens or the like could be mounted to extend inward from wall of the mandrel 20.

Figure 6:
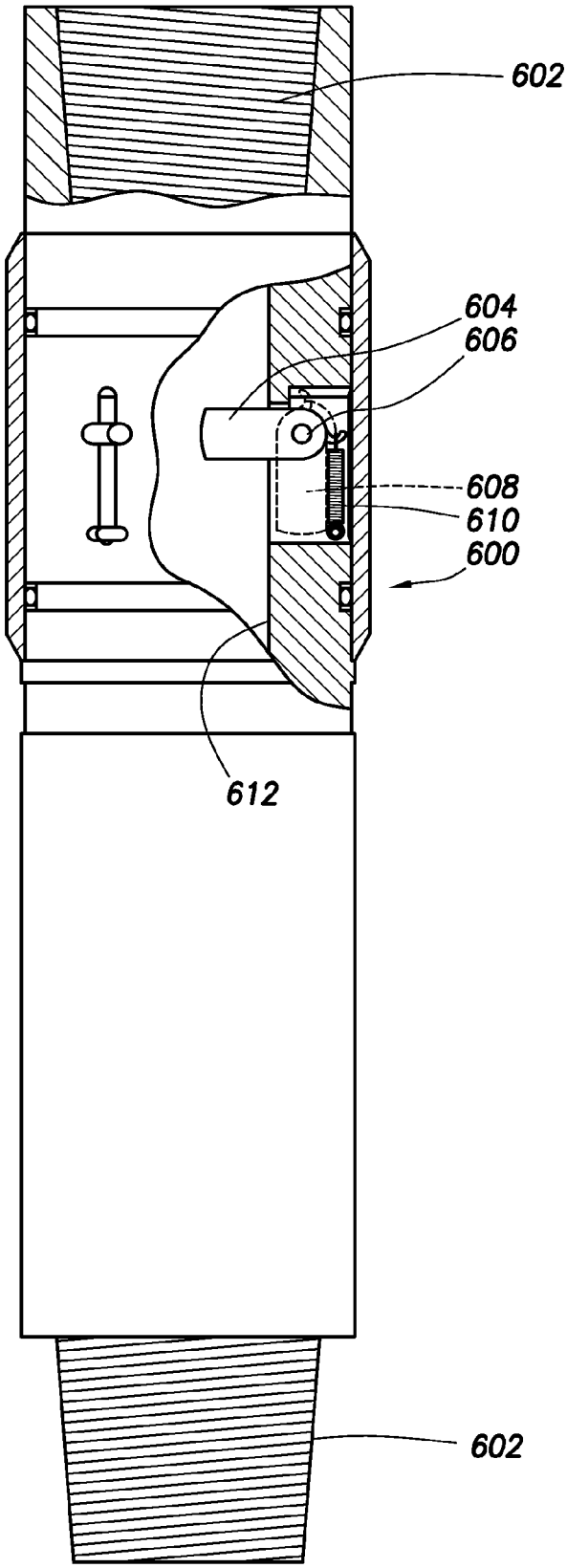
FIG. 6 is section view of a ball retainer assembly for connection to the cleanout tool of the present invention.

In FIG. 6, an alternative ball retaining assembly 600 is illustrated. This ball retaining assembly 600 has an axial passageway 612 with threads 602 at both ends for assembly into the tubing string 16 above the tool 10. A retainer 604 is pivotally mounted at 606 to rotate between a position wherein the retainer 604 is retracted into recess 608 and a position illustrated in FIG. 6 wherein the retainer extends into passageway 612. A spring 610 is connected to the retainer 604 and resiliently urges the retainer into the position illustrated in FIG. 6. As the ball 100 moves down the tubing string it moves past the retainer 604 by rotating the retainer 604 into the recess 608. When reverse circulation occurs, the ball 100 will move up central bore 11 until it contacts and is held below retainer 602.

In operation the wellbore cleanout tool 10 is assembled into a tubing string, such as a drill string, and lowered into the well. As the tool 10 is lowered into the well, the wiper elements 30 engage and slide along the wellbore wall dislodging debris and forcing the fluids in the well to move down the annulus 14 and back up through the tubing string 16. When the tool reaches its end position, reverse circulation is started and continued until the well fluids are completely flushed from the tubing string. Thereafter, drilling operations can be started a well fluids supplied to the drill bit using forward circulation.

While the preceding description contains many specificities, it is to be understood that same are presented only to describe some of the presently preferred embodiments of the invention, and not by way of limitation. Changes can be made to various aspects of the invention, without departing from the scope thereof. For example, dimensions and materials can be changed to suit particular situations; the cleanout tool can be run in conjunction with other apparatus; and various methods of use of the cleanout tool may be employed.

Therefore, the scope of the invention is not to be limited to the illustrative examples set forth above, but encompasses modifications which may become apparent to those of ordinary skill in the relevant art.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is a conflict in the usages of a word or term in this specification and other patent(s) or other documents, the definitions that are consistent with this specification should be adopted.

What is claimed is:

1. A debris removing apparatus for connection to a tubing string that is moved at the surface into a walled subterranean wellbore, comprising:

an elongated tubular shaped body having a first passageway extending through the body from one end to the other;

means on one end of the body for connection to a tubing string whereby the first passageway in the body is in fluid communication with the tubing string, and wherein the body is moved in the wellbore by manipulation of the tubing string;

a sealing element mounted on the exterior of the body, the sealing element sealing against a larger differential pressure from axially below the sealing element than above;

a second passageway in the body communicating with the exterior of said body above and below the sealing element, the second passageway bypassing the sealing element;

a one-way check valve connected to the second passageway, the valve having a valve element, a valve seat, and an actuator element resiliently urging the valve element in one direction against the valve seat, and the valve element being moveable between a first position blocking flow through the second passageway when the apparatus is moved in the wellbore and a second position for permitting both forward and reverse fluid circulation through the second passageway to bypass the sealing element.

2. The apparatus of claim 1 wherein the sealing element is of a size and shape to contact and dislodge debris from the wall of the wellbore.

3. The apparatus of claim 1 wherein the sealing element comprises a seal means for restricting fluid flow in the annulus past the body.

4. The apparatus of claim 1 wherein the sealing element is made in part from resilient material.

5. The apparatus of claim 1 wherein the actuator element is a spring.

6. The apparatus of claim 1 additionally comprising a ball and a ball seat in the first passageway, the ball mounted to be movable into and out of contact with the ball seat, and wherein the ball seat is attached to the valve element and wherein movement of the ball seat, when fluid is pumped into the tubing string and acts on the ball seated on the ball seat, moves the valve element into a second position permitting forward and reverse fluid circulation through the second passageway to bypass the sealing element.

7. The apparatus of claim 1 additionally comprising a plunger mounted for axial movement in the first passageway between a first position and a second position, the plunger being operably associated with the valve element, a ball located in the first passageway, a ball seat on the plunger enclosing the first passageway, the ball mounted to be movable into and out of contact with a ball seat whereby when the ball is in contact with the seat the first passageway is closed.

8. The apparatus of claim 7 additionally comprising a third passageway in the body bypassing the seat when the plunger is in the second position.

9. The apparatus of claim 8 wherein the third passageway comprises ports in the plunger and body.

10. A method of removing debris from a walled wellbore by inserting a tubing string into the wellbore from a wellhead comprising the steps of:

assembling a tubular body in a tubing string so that a first passageway in the body is in fluid communication with a tubing string, mounting a sealing element on the exterior of the body, providing a second passageway in the body bypassing the sealing element, and providing a valve connected to the second passageway to selectively permit and prevent flow through the second passageway;

placing the tubing string and body into the wellbore thereby forming an upper wellbore annulus between the tubing string and the wellbore wall above the sealing element and forming a lower wellbore annulus between the tubing string and the wellbore wall below the sealing element;

moving the body axially along the wellbore by axial manipulation of the tubing string from the surface while utilizing the sealing element to restrict the axial flow of fluids in the annulus past the body;

adding fluids to the upper wellbore annulus while moving the body downhole and simultaneously removing fluids from the wellbore by flowing fluids uphole through the first passageway in the body and through the tubing string; and thereafter holding the body relatively stationary in the wellbore while adding fluids to the upper wellbore annulus and simultaneously flowing fluids downhole through the second passageway in the body to bypass the sealing element and then flowing fluids uphole out of the wellbore through the tubing string; and thereafter operating the valve in response to seating a ball onto a ball seat in the first passageway, the ball at least temporarily restricting fluid flow through the first passageway; and holding the body relatively stationary in the wellbore while adding fluids into the tubing string while simultaneously flowing fluids uphole through the second passageway in the body to bypass the sealing element and flowing fluids uphole and out of the wellbore through the upper wellbore annulus.

11. The method of claim 10 wherein the moving step additionally comprises dislodging debris from the wellbore wall during the moving step.

12. The method of claim 11 wherein the step of dislodging debris from the wellbore wall comprises contacting the wellbore wall with the sealing element.

13. The method of claim 10 additionally comprising the step of assembling a drill bit in the tubing string.

14. The method of claim 13 additionally comprising the step of drilling using the drill bit while performing the step of adding fluids into the tubing string while simultaneously flowing fluids uphole through the second passageway in the body to bypass the sealing element and flowing fluids uphole and out of the wellbore through the upper wellbore annulus.

* * * * *